US007716859B1

(12) United States Patent
Chen

(10) Patent No.: US 7,716,859 B1
(45) Date of Patent: May 18, 2010

(54) GOLF CLUB BAG TAG

(75) Inventor: Yin-Hai Chen, Taipei (TW)

(73) Assignee: Dragonseas & Co., Ltd., Taipei (TW)

( * ) Notice: Subject to any disclaimer, the term of this patent is extended or adjusted under 35 U.S.C. 154(b) by 0 days.

(21) Appl. No.: 12/350,972

(22) Filed: Jan. 9, 2009

(51) Int. Cl.

| | |
|---|---|
| ***G09F 3/20*** | (2006.01) |
| ***A63B 57/00*** | (2006.01) |
| ***A63B 53/06*** | (2006.01) |
| ***A63B 53/16*** | (2006.01) |

(52) U.S. Cl. ..... 40/6; 473/406; 473/408; 473/272

(58) Field of Classification Search ..... 40/6; 473/406, 408, 272

See application file for complete search history.

(56) References Cited

U.S. PATENT DOCUMENTS

| | | | | |
|---|---|---|---|---|
| 4,960,278 | A * | 10/1990 | Hainey | 473/407 |
| 7,189,166 | B2 * | 3/2007 | Pare | 473/282 |
| 2008/0230435 | A1 * | 9/2008 | Cope | 206/579 |

* cited by examiner

*Primary Examiner*—Lesley Morris
*Assistant Examiner*—Syed A Islam
(74) *Attorney, Agent, or Firm*—Leong C. Lei

(57) ABSTRACT

A golf club bag tag contains a tag body, a connection element, and at least a golf tool such as a divot repair tool or a golf ball marker. The tag body has a first major surface with an indentation for the embedment of the golf tool. The tag body could be hung on a golf club bag or a waist belt of a golfer by the connection element so that the golfer would not forget to bring the golf tool.

1 Claim, 9 Drawing Sheets

GOLF CLUB BAG TAG

TECHNICAL FIELD OF THE INVENTION

The present invention generally relates to golf accessories, and more particularly to a golf club bag tag integrating a number of golf tools.

DESCRIPTION OF THE PRIOR ART

Repairing the divot on the green after a golf ball hit is considered a responsibility of the golfer, especially when there is no caddie to do the work. There is a fork-like divot repair tool (or it is called Green Fork by the Japanese or the Europeans) often used by the golfers to repair the divot on green.

In addition to the divot repair tool, the golf ball marker that marks the location of the golf ball on the green is also a common accessory to the golfers. However, the golfers often forget to carry the divot repair tool and the golf ball marker with them to the field. On the other hand, most golf club bags have a tag attached to them for identification purpose only. Therefore, an integration of the golf club bag tag with the divot repair tool and/or the golf ball marker would be very handy for the golfers.

SUMMARY OF THE INVENTION

A golf club bag tag of the present invention contains a tag body, a connection element, and at least a golf tool. The tag body has a first major surface with an indentation for the embedment of the golf tool. The tag body could be hung on a golf club bag or a waist belt of the golfer by the connection element so that a golfer would not forget to bring the golf tool.

On the second major surface of the tag body, the tag body has another indentation where a mark or name plate is embedded.

Both the golf tool and the indentation could contain a magnetic element or, alternatively, one of them contains a magnetic element while the other one contains a metallic material. As such, the golf tool is reliably held in the indentation by magnetic attraction.

The aforementioned magnetic element is embedded in a protrusion of the golf tool or inside the indentation.

The tag body could further contain a number of swiveling arms on the first major surface. The swiveling arms could be turned to prevent the golf tool from falling off from the indentation.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 5, a golf club bag tag according to a first embodiment of the present invention contains a flat tag body 10, a connection element 20 such as a belt, a flat first tool 30 such as divot repair tool, and a flat second tool 40 such as a golf ball marker.

Figure 1:
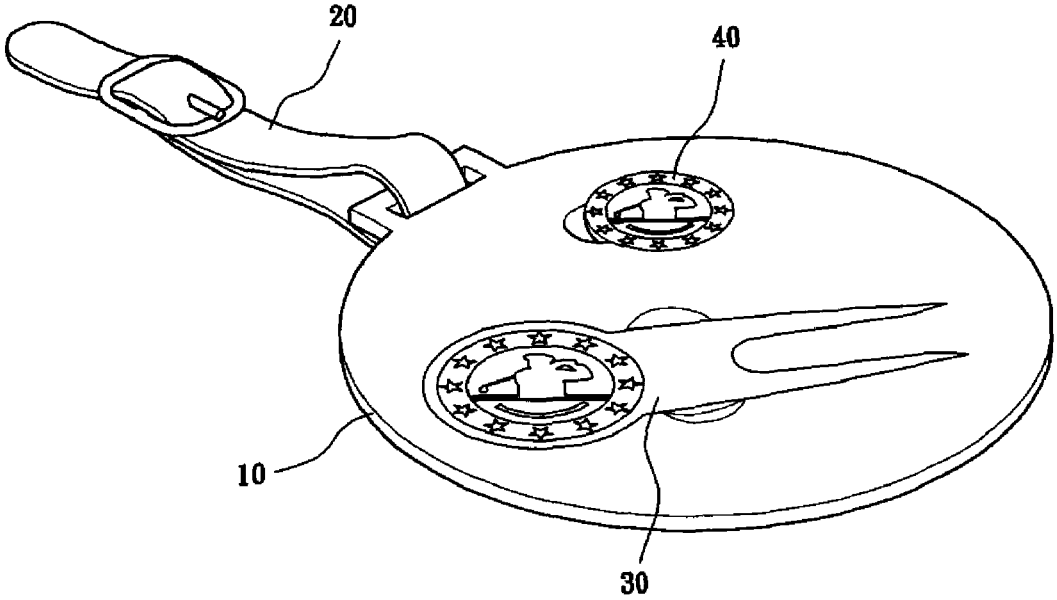
FIG. 1 is a perspective diagram showing a first major surface of a golf club bag tag according to a first embodiment of the present invention.
Figure 2:
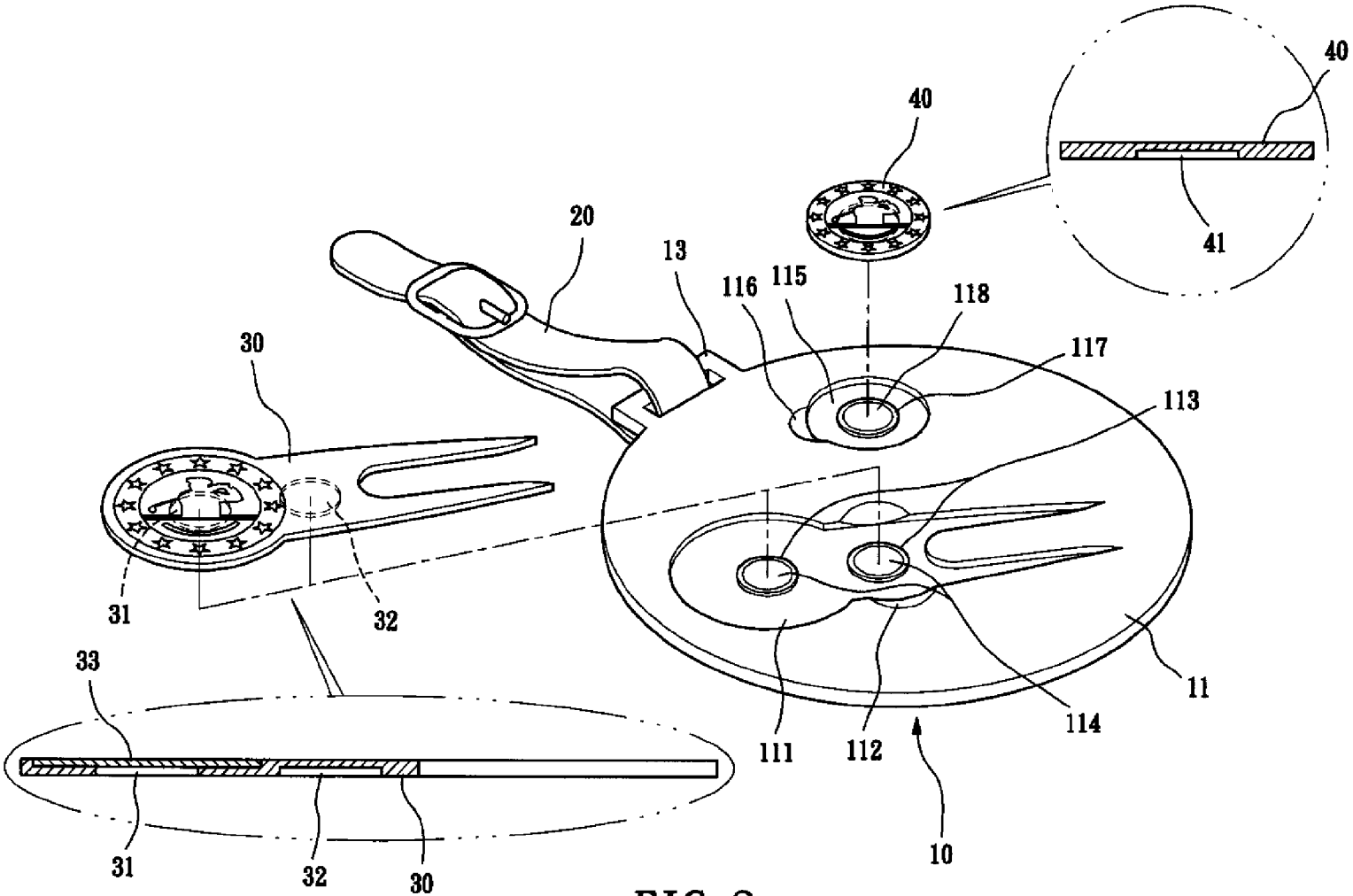
FIG. 2 is a perspective exploded diagram showing the components of the first major surface of the golf club bag tag of FIG. 1.
Figure 3:
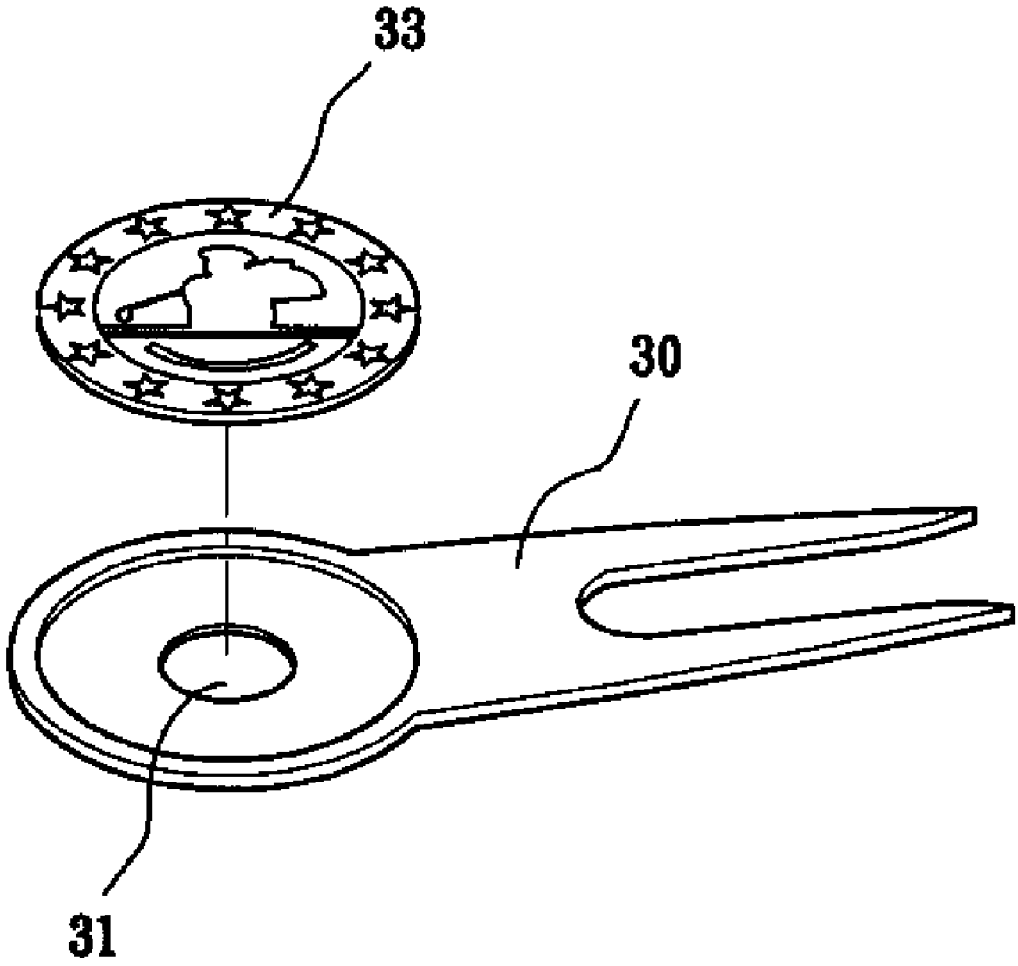
FIG. 3 is a perspective exploded diagram showing the components of the first tool of the golf club bag tag of FIG. 1.
Figure 4:
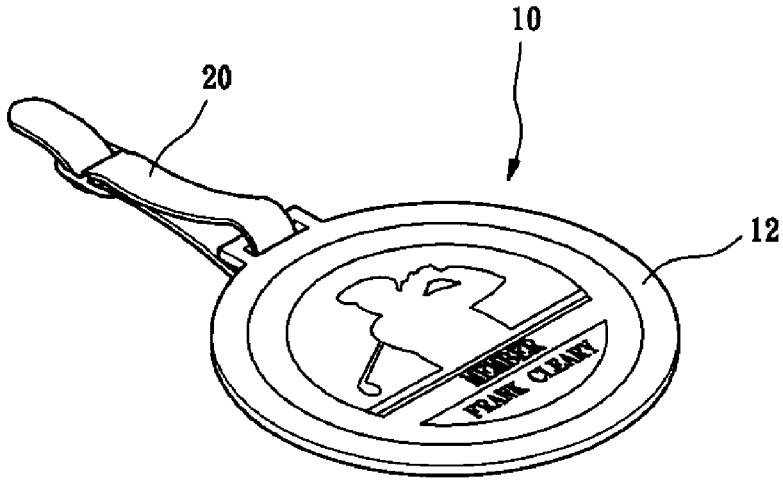
FIG. 4 is a perspective diagram showing the second major surface of the golf club bag tag of FIG. 1.
Figure 5:
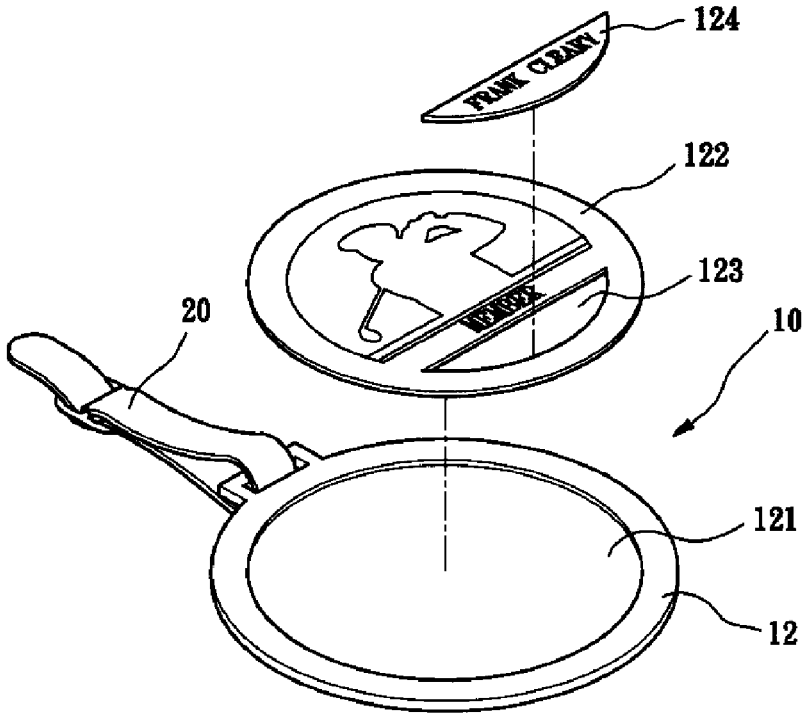
FIG. 5 is a perspective exploded diagram showing the components of the second major surface of the golf club bag tag of FIG. 1.

The flat tag body 10 has a first major surface 11 and a second major surface 12 (see FIGS. 4 and 5). On the first major surface 11, the tag body 10 has a first indentation 111 whose shape substantially conforms to that of the first tool 30 so as to accommodate the first tool 30. The first indentation 111 is extended outward from its circumference to form at least a shallower first groove 112. Inside the first indentation 111, there are two first protrusions 113, each embedded with a magnetic element 114. Similarly, the tag body 10 has a second indentation 115 on the first major surface 11 whose shape substantially conforms to that of the second tool 40 so as to accommodate the second tool 40. The second indentation 115 is extended outward from its circumference to form a shallower second groove 116. Inside the second indentation 115, there is a second protrusion 117 embedded with a magnetic element 118. On the second major surface 12, the tag body 10 has a third indentation 121 where mark plate 122 and a name plate 124 are both embedded. In the present embodiment, the mark plate 122 has a through opening 123 where the name plate 124 is fitted.

The tag body 10 also has a ring element 13 along a circumference of the tag body 10 for joining with the connection element 20 which, in the present embodiment, is a belt running through the ring element 13 and has a buckle for closing the belt and for adjusting the length of the belt.

The first tool 30 of the present embodiment is a divot repair tool. The first tool 30 has a through opening 31 and an indentation 32 on a second major surface, both located correspondingly to the first protrusions 113. The first tool 30 also has a metallic mark plate 33 embedded into a first major surface of the first tool 30 and covers the through opening 31 so that the through opening 31 becomes a blind hole. When the first tool 30 is placed inside the first indentation 111 of the tag body 10, the first protrusions 113 are accommodated by the through opening 31 and the indentation 32, respectively. The metallic mark plate 33 is attracted by the magnetic element 114 through the through opening 31 so that the first tool 30 does not fall off from the first indentation 111. In an alternative embodiment, the metallic mark plate 33 is replaced by a magnetic mark plate.

The second tool 40 is a golf ball marker and could be made of a metallic or magnetic material. On a second major surface of the second tool 40, there is an indentation 41 located correspondingly to the second protrusion 117. When the second tool 40 is placed inside the second indentation 115 of the tag body 10, the second protrusion 117 is accommodated by the indentation 41. The second tool 40 is attracted by the magnetic element 118 of the second protrusion 117 so that the second tool 40 does not fall off from the second indentation 115. Please note that some pattern or mark is directly engraved on a first major surface of the second tool 40.

Figure 6:
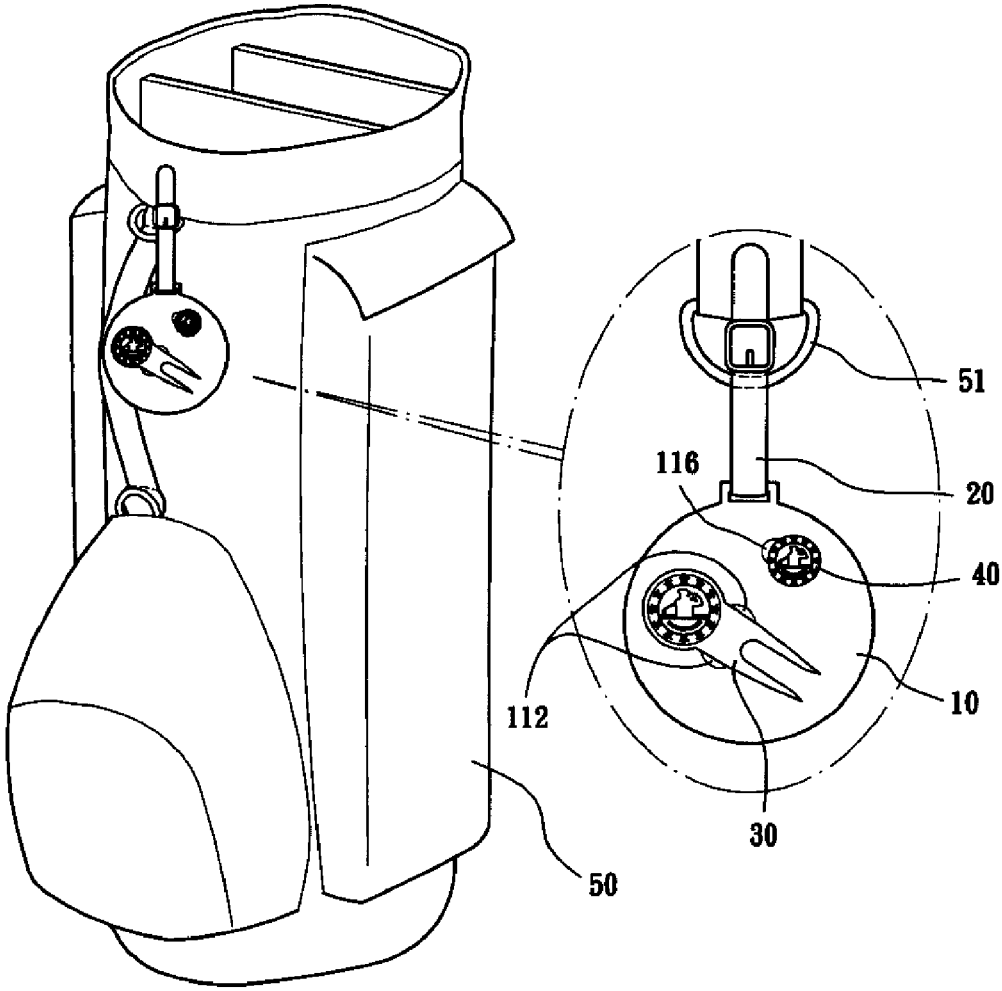
FIG. 6 is a schematic diagram showing an application scenario of the golf club bag tag of FIG. 1 where it is hung on a golf club bag.
Figure 7A:
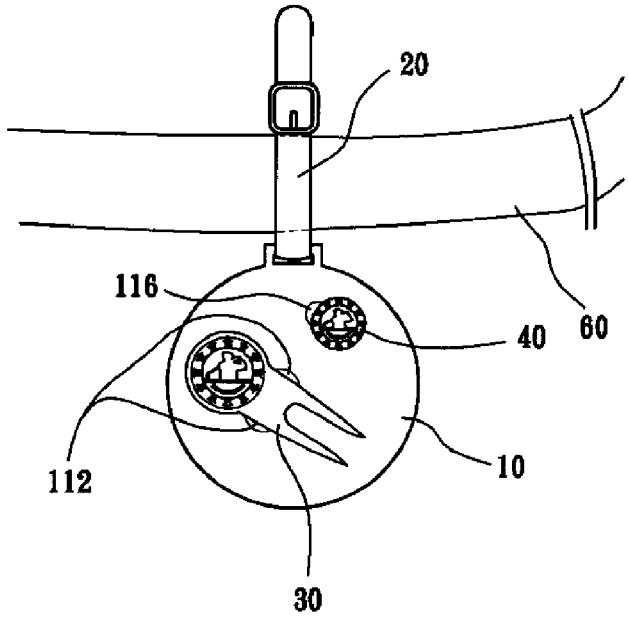
FIGS. 7*a* and 7*b* are schematic diagrams showing another two application scenarios of the golf club bag tag of FIG. 1 where it is hung on a golfer's waist belt.
Figure 7B:
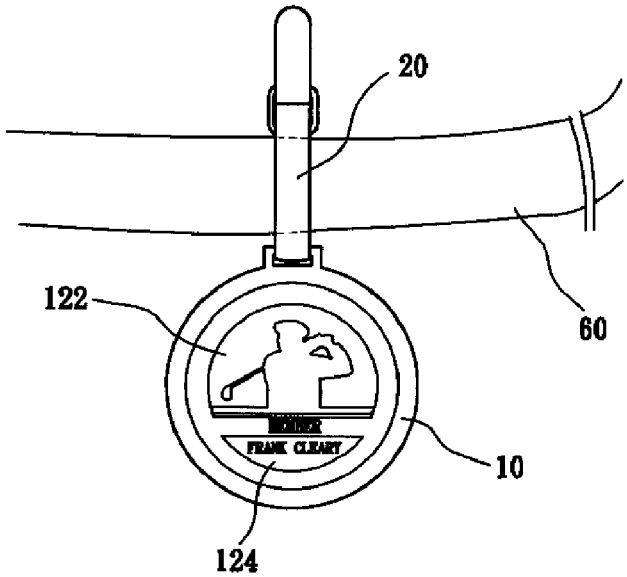

As illustrated in FIGS. 6, 7*a*, and 7*b*, the golf club bag tag of the present embodiment could be hung on a ring 51 of a golf club bag 50 or on a waist belt 60 of a golfer. As such, the golfer will never forget to bring the golf ball marker 40 and the divot repair tool 30 and the originally dull bag tag has become a more valuable accessory.

Additionally, as shown in FIG. 7*b* where the mark plate 122 and the name plate 124 are faced outward, the bag tag still maintains its advertisement and identification purpose.

Figure 8:
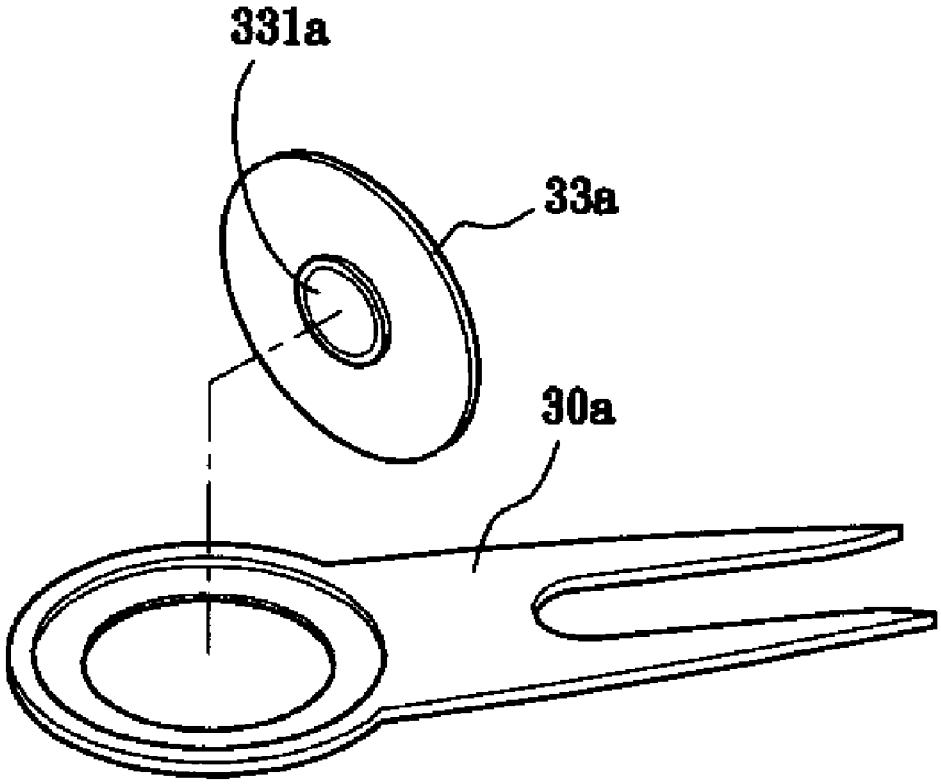
FIG. 8 is a perspective diagram showing another embodiment of the first tool of the golf club bag tag.

FIG. 8 shows another embodiment of the first tool. As illustrated, the first tool 30*a* has its mark plate 33*a* made of a non-metallic material. However, on a major surface of the mark plate 33*a* that is to face the tag body 10, there is a metallic or magnetic element 331*a* located correspondingly to one of the first protrusions 113 so that the first tool 30*a* could still be held reliably by magnetic attraction between the mark plate 33*a* and a magnetic element 114.

Figure 9:
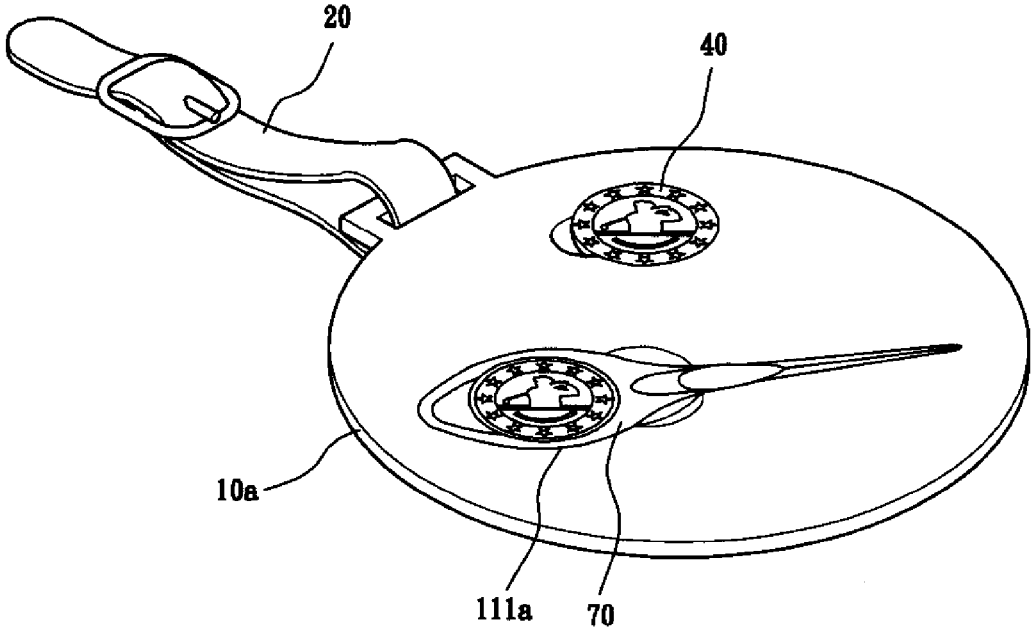
FIG. 9 is a perspective diagram showing a golf club bag tag according to a second embodiment of the present invention.

FIG. 9 shows another embodiment of the tag body. As illustrated, the tag body 10*a* has a first indentation 111*a* whose shape substantially conforms to a third tool 70 which, in the present embodiment, is a single-prong divot repair tool.

Figure 10:
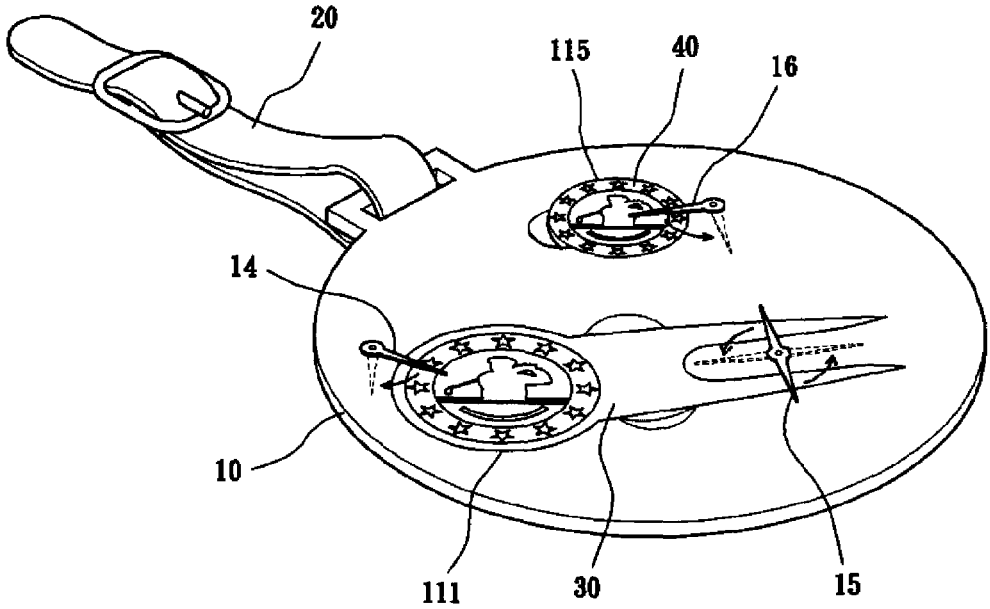
FIG. 10 is a perspective diagram showing a golf club bag tag according to a third embodiment of the present invention.

FIG. 10 shows yet another embodiment of the tag body. As illustrated, for each tool carried with the tag body 10, there are swiveling arms 14, 15, and 16 located on the first major surface 11 and adjacent to the tools 30 and 40, respectively. By turning the swiveling arms 14, 15, and 16 so that they are extended in front of the tools 30 and 40, the tools 30 and 40 are further prevented from falling off from the first and second indentations 111 and 115. Then, by turning the swiveling arms 14, 15, and 16 so that they are not interfering with the tools 30 and 40, the tools 30 and 40 could be removed as usual.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A golf club bag tag, comprising:

a first golf tool having a first major surface, a second major surface and a through opening, a metallic mark plate embedded said first major surface to cover said through opening so that said through opening becomes a blind hole, said second major surface having an indentation;

a second golf tool made of metallic material and having an indentation;

a flat tag body having a first major surface and a second major surface, said first major surface having a first indentation and a second indentation, said first indentation being shaped to receive said first golf tool and being extended outward to form at least a shallower first groove, said first indentation being provided with two first protrusions each embedded with a magnetic element, said second indentation being shaped to receive said second golf tool and being extended outward to form a shallower second groove, said second indentation being provided with a second protrusion embedded with a magnetic element, said second major surface having a third indentation embedded with a mark plate and a name plate, said mark plate having a through opening where said name plate is fitted, said tag body having a ring element for joining with a belt;

said through opening and said indentation of said first golf tool being located to receive said first protrusions of said tag body, said mark plate being attracted by said magnetic element of one of said first protrusions thereby preventing said first golf tool from falling off said first indentation of said tag body, said indentation of said second golf tool being located to receive and to be attracted by said magnetic element of said second protrusion of said tag body thereby preventing said second golf tool from falling off said second indentation of said tag body.

* * * * *